United States Patent [19]

Burmeister

[11] Patent Number: 4,949,230

[45] Date of Patent: Aug. 14, 1990

[54] LIGHT ATTACHMENT FOR A REMOTE CONTROL UNIT

[76] Inventor: Curtis R. Burmeister, 65 Independence Rd., Feeding Hills, Mass. 01030

[21] Appl. No.: 381,845

[22] Filed: Jul. 19, 1989

[51] Int. Cl.[5] ..... F21V 33/00

[52] U.S. Cl. ..... 362/109; 362/23; 362/85; 362/86; 362/190

[58] Field of Search ..... 362/109, 190, 191, 23, 362/85, 86

[56] References Cited

U.S. PATENT DOCUMENTS

| | | | |
|---|---|---|---|
| 1,636,211 | 7/1927 | Bramming | 362/86 |
| 2,805,324 | 9/1957 | Zedric, Jr. | 362/86 |
| 2,918,036 | 12/1959 | Giordana | 362/23 |
| 3,009,051 | 11/1961 | Bittrolff | 362/23 |
| 3,092,335 | 6/1963 | Wilson | 362/191 |
| 4,432,042 | 2/1984 | Zeller | 362/190 |
| 4,772,986 | 9/1988 | McNemar | 362/23 |
| 4,779,170 | 10/1988 | Lockwood et al. | 362/86 |
| 4,823,241 | 4/1989 | Trattner | 362/190 |
| 4,831,500 | 5/1989 | McNemar | 362/23 |

*Primary Examiner*—Ira S. Lazarus
*Assistant Examiner*—Sue Hagarman
*Attorney, Agent, or Firm*—Jerry T. Kearns

[57] ABSTRACT

A light attachment for a remote control unit, of the type utilized to control television, video cassette recorders and stereos, includes a generally L-shaped body member. Cooperating hook and loop type fasteners are provided on a first leg portion of the body member and on a bottom surface of the remote control unit housing for securing the body member across a width of the remote control unit housing. A second leg portion of the light attachment is dimensioned to extend above the remote control key pad to orient an attached lamp above the key pad to provide illumination. Batteries are received in the body member for powering the lamp and a switch is mounted on an end face of the second leg member for selectively illuminating the lamp. In a second embodiment, the lamp is mounted on a rotatable and extensible post for compound adjustment.

6 Claims, 3 Drawing Sheets

LIGHT ATTACHMENT FOR A REMOTE CONTROL UNIT

BACKGROUND OF THE INVENTION

1. Field of the Invention

The present invention relates to light attachments, and more particularly pertains to light attachment for remote control units of the type utilized to control electronic devices such as televisions, video cassette recorders and stereos. Many individuals utilize such as electronic devices in dimly lit room environments. This makes it difficult to see the control keys of the remote control unit without turning on room lighting. In order to overcome this problem, the present invention provides a light attachment including a selectively actuatable lamp for illuminating control keys of a remote control unit.

2. Description of the Prior Art

Various types of light attachments are known in the prior art. A typical example of such a light attachment is to be found In U.S. Pat. No. 4,153,927, which issued to O. Owens on May 8, 1979. This patent discloses a housing provided with lights for illuminating the top surface of a clipboard and for providing a spot light. The device is designed for use by law enforcement officers. U.S. Pat. No. 4,195,329, which issued to P. Woog on Mar. 25, 1980, discloses a diagnostic lamp for fluorescent examination of the teeth and gums of an individual. A housing includes a light source, a battery and a switch for selectively illuminating the light source. U.S. Pat. No. 4,311,208, which issued to P. Macrorie et al on Jan. 19, 1982, discloses a safety lamp attachment for use on ladders. The lamp assembly includes a switch activated by a person's foot placed on one of the lower rungs of the ladder. U.S. Pat. No. 4,446,508, which issued to M. Kinzie on May 1, 1984, discloses an article holder having a plurality of circular openings for the reception of beverage containers. The device is adapted for mounting the interior of a motor vehicle and is formed from a transparent material. A light source is located within the plane of walls or wet portions of the holder to illuminate the edges of the circular openings. U.S. Pat. No. 4,766,525, which issued to B. Loughlin on Aug. 23, 1988, discloses a ladder attachment beacon to a fire fighting and rescue personnel in locating a ladder in poor visibility conditions.

While the above mentioned devices are directed to light attachments, none of these devices disclose a light attachment for illuminating the key pad of a remote control unit. Inasmuch as the art is relatively crowded with respect to these various types of light attachments, it can be appreciated that there is a continuing need for and interest in improvements to such light attachments, and in this respect, the present invention addresses this need and interest.

SUMMARY OF THE INVENTION

In view of the foregoing disadvantages inherent in the known types of light attachments now present in the prior art, the present invention provides an improved light attachment for a remote control unit. As such, the general purpose of the present invention, which will be described subsequently in greater detail, is to provide a new and improved light attachment for a remote control unit which has all the advantages of the prior art light attachments and none of the disadvantages.

To attain this, representative embodiments of the concepts of the present invention are illustrated in the drawings and make use of a light attachment for a remote control unit, of the type utilized to control televisions, video cassette recorders and stereos, which includes a generally L-shaped body member. Cooperating hook and loop type fasteners are provided on a first leg portion of the body member and on a bottom surface of the remote control unit housing for securing the body member across a width of the remote control unit housing. A second leg portion of the light attachment is dimensioned to extend above the remote control key pad to orient an attached lamp above the key pad to provide illumination. Batteries are received in the body member for powering the lamp and a switch is mounted on an end face of the second leg member for selectively illuminating the lamp. In a second embodiment, the lamp is mounted on a rotatable and extensible post for compound adjustment.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way It is therefore an object of the present invention to provide a new and improved light attachment for a remote control unit which has all the advantages of the prior art light attachments and none of the disadvantages.

It is another object of the present invention to provide a new and improved light attachment for a remote control unit which may be easily and efficiently manufactured and marketed.

It is a further object of the present invention to provide a new and improved light attachment for a remote control unit which is of a durable and reliable construction.

An even further object of the present invention is to provide a new and improved light attachment for a remote control unit which is susceptible of a low cost of manufacture with regard to both materials and labor, and which accordingly is then susceptible of low prices of sale to the consuming public, thereby making such light attachments economically available to the buying public.

Still yet another object of the present invention is to provide a new and improved light attachment for a remote control unit which provides in the apparatuses and methods of the prior art some of the advantages thereof, while simultaneously overcoming some of the disadvantages normally associated therewith.

Still another object of the present invention is to provide a new and improved light attachment for a remote control unit including a selectively illuminated lamp for illuminating the remote control key pad in dimly lit room environments.

Yet another object of the present invention is to provide a new and improved light attachment for a remote control unit which may be reversibly attached to a remote control unit to allow left or right hand operation.

Even still another object of the present invention is to provide a new and improved light attachment for a remote control unit which provides a self contained lamp, battery and switch assembly These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
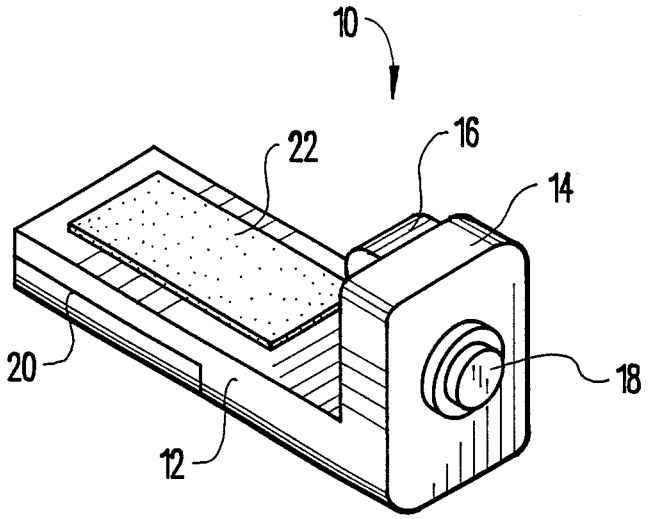
FIG. 1 is a perspective view of an upper surface of a light attachment according to a first embodiment of the present invention.

With reference now to the drawings, and in particular to FIG. 1 thereof, a new and improved light attachment for a remote control unit embodying the principles and concepts of the present invention and generally designated by the reference numeral 10 will be described.

More specifically, it will be noted that the first embodiment 10 of the invention includes an L-shaped body member formed by first 12 and second 14 generally perpendicular leg portions. A reflective hood 16 is provided on an inner face of the leg portion 14 and encloses an electric lamp. A push button type switch 18 is provided on an outer end face of the second leg portion 14 for selectively illuminating the lamp. The first leg portion 12 includes a removable cover 20 to allow replacement of batteries received therein. Alternatively, the light attachment 10 may be formed as a disposable unit designed for replacement when the batteries have been exhausted. A hook and loop type fastening member 22 is adhesively secured on a upper face of the first leg member 12 for engagement with a cooperating fastening members secured on a lower surface of a conventional elongated rectangular remote control unit. The cooperating hook and loop fastening members are preferably of the type sold under the trademark VELCRO.

Figure 2:
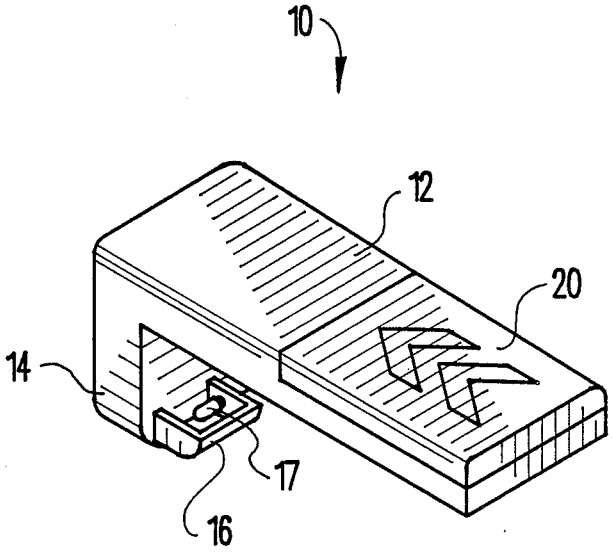
FIG. 2 is a perspective view of a bottom surface of a light attachment according to the first embodiment of the present invention.

FIG. 2 is a perspective view illustrating the bottom surface of the first leg portion 12, including the removable battery cover 20. The lamp 17 is mounted within the reflective hood 16 secured on the second leg portion 14.

Figure 3:
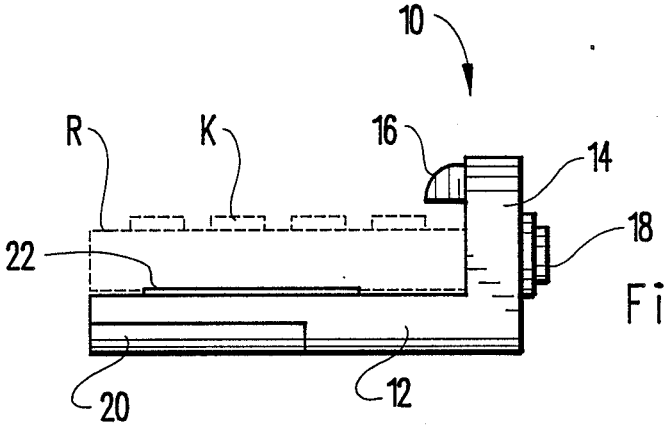
FIG. 3 is a side view illustrating the light attachment of the first embodiment of the present invention installed on a remote control unit.

FIG. 3 is a side view which illustrates the light attachment 10 secured by the fastening member 22 to a cooperating fastening member on the bottom surface of a conventional remote control unit R. The first leg member 12 is dimensioned to extend across a width of the remote control unit R and the second leg portion 14 is dimensioned to orient the lamp within the reflective hood 16 above the key pad K on the upper surface of the remote control unit R. Thus, by depressing the switch 18, an individual may selectively illuminate the key pad K to allow use in a dimly lit room environment.

Figure 4:
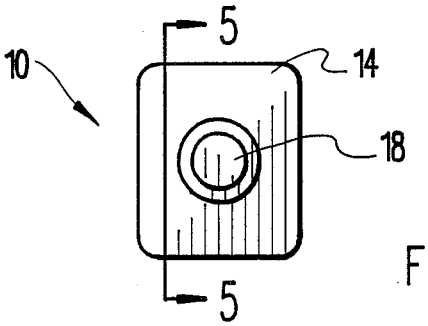
FIG. 4 is an end view of the light attachment of the first embodiment of the present invention.

FIG. 4 is an end view illustrating the outer face of the leg portion 14, on which the push button type switch 18 is centrally mounted.

Figure 5:
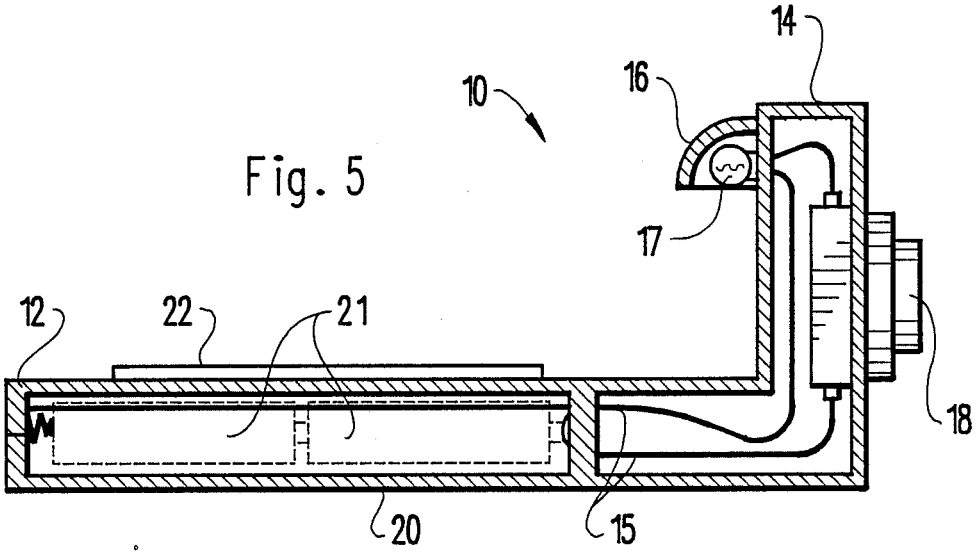
FIG. 5 is a cross sectional view, taken along line 5—5 of FIG. 4.

FIG. 5 is a cross sectional view which illustrates the batteries 21 connected by electrical wiring 1 through the switch 18 to selectively illuminate the lamp 17 within the reflective hood 16. As an alternative to the cylindrical type of dry cell batteries 21, the flat button type of batteries may be utilized to allow a reduction in size of the body member of the light attachment 10.

Figure 6:
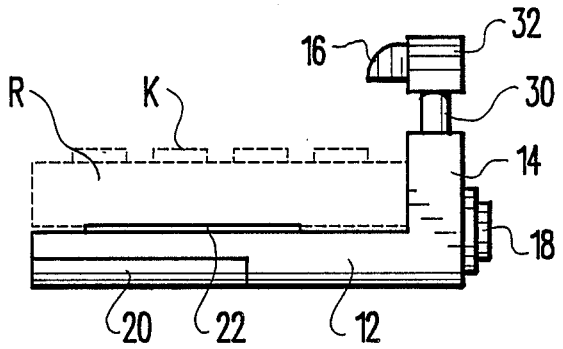
FIG. 6 is a side view illustrating a light attachment according to a second embodiment of the present invention, installed on a remote control unit.

FIG. 6 is a side view which illustrates a slightly modified light attachment 10′ according to a second embodiment of the present invention. The second embodiment 10′ is substantially similar to the first embodiment 10 and like reference numerals have been utilized to identify similar parts. A rotatable and extensible post 30 is secured through an aperture provided in a top face of the second leg portion 14, and includes a lamp mounting member 32 on which the reflective hood 16 is disposed.

Figure 7:
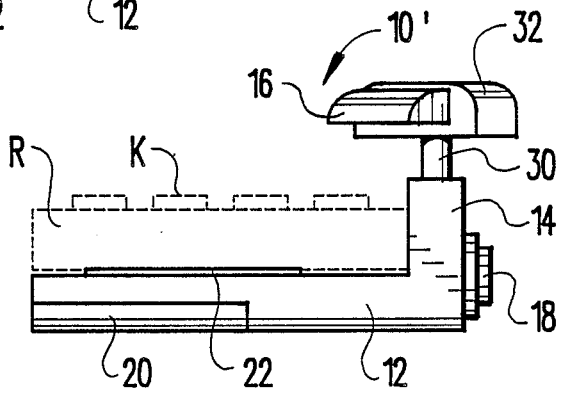
FIG. 7 is a side view of the light attachment of FIG. 6, with an adjustable light mounting post rotated to an angular orientation.

As shown in FIG. 7, the lamp mounting member 32, attached to the rotatable post 30, may be adjusted to orient the lamp within the hood 16 to illuminate different portions of the key pad K of the remote control unit R.

Figure 8:
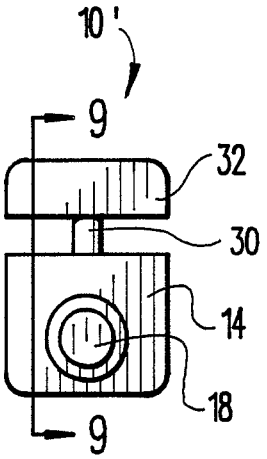
FIG. 8 is an end view of the light attachment of FIG. 6.

FIG. 8 is an end view of the light attachment 10'.

Figure 9:
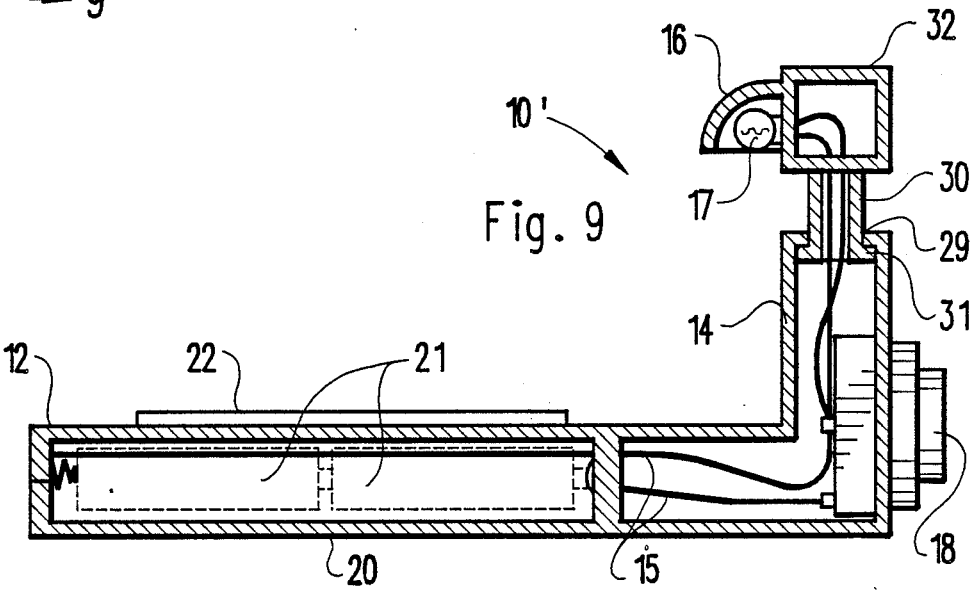
FIG. 9 is cross sectional view, taken along line 9—9 of FIG. 8.

As shown in the cross sectional view of FIG. 9, the post 30 extends through a circular opening 29 in the top wall of the second leg member 14 and includes a radially outwardly extending retaining flange 31. The post 30 is dimensioned for frictional engagement within the aperture 29 such that a selected adjusted position will be maintained. To facilitate this objective, the retaining flange 31 may be formed from a resilient material for abutment with the interior wall surfaces of the leg portion 14. The post 30 is hollow and provides a conduit for the electrical wiring 15 for connection with the lamp 17 mounted in the reflective hood 16. The rotational and axial adjustability of the post 30 allows the lamp 17 to be adjusted to an ideal position for use with various different remote control units.

As may now be understood, the present invention discloses a light attachment which may be quickly retrofitted to conventional elongated rectangular remote control units to allow convenient usage in dimly lit room environments. As an alternative to the hook and loop type fasteners previously described, other fastening means may be employed, for example snaps, adhesives and resilient clips. Finally, it should be noted that the light may be integrally formed with a remote control unit and provided as an original equipment item.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A light attachment for illuminating control keys on a remote control unit of the type utilized for controlling stereos, televisions and video cassette recorders, said light attachment comprising:

a generally L-shaped body member having first and second generally perpendicular hollow leg portions;

fastening means on an upper face of said first leg portion for securing said body member to a lower surface of a remote control unit;

an extensible and rotatable post extending upwardly through a circular aperture in a top wall of said second leg portion;

said post dimensioned for frictional engagement within said aperture for maintaining a selected adjusted position;

a radially outwardly extending retaining flange formed on an end of said post within said second leg portion;

said retaining flange formed from a resilient material and dimensioned for abutment with interior wall surfaces of said second leg portion;

a lamp mounted on said post for illuminating keys of a remote control unit;

a reflecting hood on said post, surrounding said lamp;

said first leg portion dimensioned to extend across a width of a remote control unit and said second leg portion dimensioned to orient said lamp above a key pad of a remote control unit;

battery means in said body member for powering said lamp;

and switch means on an outwardly directed exterior side wall of said second leg portion for selectively illuminating said lamp.

2. The light attachment for a remote control unit of claim 1, wherein said light attachment is reversible for right or left hand operation.

3. The light attachment for a remote control unit of claim 1, wherein said fastening means comprise cooperating hook and loop fasteners.

4. In combination with a remote control unit of the type utilized to control stereos, televisions and video cassette recorders, and having an elongated generally rectangular housing with a key pad provided on an upper surface, the improvement comprising:

a generally L-shaped body member having first and second generally perpendicular hollow leg portions;

fastening means on an upper face of said first leg portion securing said body member to a lower surface of said remote control unit;

an extensible and rotatable post extending upwardly through a circular aperture in a top wall of said second leg portion;

said post dimensioned for frictional engagement within said aperture for maintaining a selected adjusted position;

a radially outwardly extending retaining flange formed on an end of said post within said second leg portion;

said retaining flange formed from a resilient material and dimensioned for abutment with interior wall surfaces of said second leg portion;

a lamp mounted on said post for illuminating keys of said remote control unit;

a reflecting hood on said post, surrounding said lamp;

said first leg portion extending across a width of said remote control unit and said lamp oriented above a key pad of said remote control unit;

battery means in said body member for powering said lamp;

and switch means on an outwardly directed exterior side wall of said second leg portion for selectively illuminating said lamp.

5. The light attachment for a remote control unit of claim 4, wherein said fastening means comprise cooperating hook and loop fasteners on said body member and on said housing.

6. The light attachment for a remote control unit of claim 4, wherein said light attachment is reversible for left or right hand operation.

* * * * *